US006306498B1

(12) United States Patent
Yuuki et al.

(10) Patent No.: US 6,306,498 B1
(45) Date of Patent: Oct. 23, 2001

(54) FIBERS FOR ELECTRIC FLOCKING AND ELECTRICALLY FLOCKED ARTICLE

(75) Inventors: Yasunori Yuuki, Toyonaka; Toshihiko Ohira, Ibaraki, both of (JP)

(73) Assignee: Asahi Kasei Kabushiki Kaisha, Osaka (JP)

( * ) Notice: Subject to any disclaimer, the term of this patent is extended or adjusted under 35 U.S.C. 154(b) by 0 days.

(21) Appl. No.: 09/582,029

(22) PCT Filed: Dec. 21, 1998

(86) PCT No.: PCT/JP98/05774

§ 371 Date: Jun. 21, 2000

§ 102(e) Date: Jun. 21, 2000

(87) PCT Pub. No.: WO99/32695

PCT Pub. Date: Jul. 1, 1999

(30) Foreign Application Priority Data

Dec. 22, 1997 (JP) ..... 9-352660
Mar. 19, 1998 (JP) ..... 10-070086

(51) Int. Cl.[7] ..... D01F 6/00

(52) U.S. Cl. ..... 428/359; 428/364; 428/90; 428/97

(58) Field of Search ..... 428/90, 97, 373, 428/364, 359

(56) References Cited

U.S. PATENT DOCUMENTS 3,865,678 * 2/1975 Okamoto et al. ..... 161/6
5,782,935 * 7/1998 Hirt et al. ..... 8/512

FOREIGN PATENT DOCUMENTS 1254826 11/1971 (GB) .
52-5320 1/1977 (JP) .
5-59610 3/1993 (JP) .
8-127917 5/1996 (JP) .
WO 99/11709 3/1999 (WO) .
WO 99/11845 3/1999 (WO) .

* cited by examiner

*Primary Examiner*—N. Edwards
(74) *Attorney, Agent, or Firm*—Finnegan, Henderson, Farabow, Garrett & Dunner, L.L.P.

(57) ABSTRACT

A poly(trimethylene terephthalate) short fiber having a cut length of 0.2–3 mm, and electrostatically flocked goods prepared by electrostatically flocking the poly(trimethylene terephthalate) fiber, are described.

According to the present invention, there can be provided a fiber, for electrostatic flocking, which has excellent tread-proofness, scratch resistance and light resistance, and electrostatically flocked goods which have an excellent appearance.

2 Claims, No Drawings

FIBERS FOR ELECTRIC FLOCKING AND ELECTRICALLY FLOCKED ARTICLE

TECHNICAL FIELD

The present invention relates to fibers for electrostatic flocking, and electrostatically flocked goods. More particularly, it relates to poly(trimethylene terephthalate)-based fibers, for electrostatic flocking, which have an excellent dispersibility, and electrostatically flocked goods which have an excellent appearance and also have an excellent tread-proofness and light resistance.

BACKGROUND ART

As the fiber for electrostatic flocking, a nylon fiber has exclusively been employed heretofore. In particular, the nylon fiber having soft hand has exclusively been employed in uses such as automobile interiors, but has poor light resistance. Thus, there has been required electrostatically flocked goods which have soft hand, dispersibility of standing fibers, and an excellent appearance in uses such as car seat coverings.

On the other hand, a general-purpose polyester fiber containing polyethylene terephthalate) as a principal component has an excellent light resistance as a fiber for electrostatic flocking. However, a general-purpose polyester fiber has a poor tread-proofness, a soft hand, poor dispersibility of standing fibers and a poor appearance so that its use is limited. There has been disclosed a suggestion (Unexamined Patent Publication (Kokai) No. 5-59610) of improving poor tread-proofness by using a fiber having a flat section in electrostatic flocking of the general-purpose polyester fiber. As a result, the properties were slightly improved, but satisfactory properties have not been obtained. Therefore, a further improvement has been required.

DISCLOSURE OF THE INVENTION

An object of the present invention is to provide a fiber for electrostatic flocking, which has an excellent dispersibility, and electrostatically flocked goods which have an excellent appearance and also have excellent tread-proofness, scratch resistance and light resistance.

The present inventors have found that the object can be attained by selectively employing a specific polyester fiber as a fiber for electrostatic flocking.

That is, the object of the present invention can be attained by a poly(trimethylene terephthalate)-based fiber for electrostatic flocking, the fiber being a short fiber having a cut length of 0.2–3.0 mm.

The present invention is also directed to electrostatically flocked goods formed of the poly(trimethylene terephthalate)-based short or chopped fiber having a cut (chopped) length of 0.2–3.0 mm.

The present invention will be described in detail below.

The poly(trimethylene terephthalate)-based fiber used in the present invention refers to a polyester fiber comprising trimethylene terephthalate units, as principal repeating units, in an amount of about 50 mol % or more, preferably 70% or more, more preferably 80 mol % or more, and most preferably 90% or more. Accordingly, the poly(trimethylene terephthalate)-based fiber according to the present invention includes a poly(trimethylene terephthalate) fiber containing another acid component and/or glycol component, as a third component, in the total amount of about 50 mol % or less, preferably 30 mol % or less, more preferably 20 mol % or less, and most preferably 10% or less.

Poly(trimethylene terephthalate) is synthesized by combining terephthalic acid or a functional derivative thereof, for example, dimethyl terephthalate, with trimethylene glycol in the presence of a catalyst under suitable reaction conditions. In this synthesis process, a suitable one or more third components may be added to form a copolymer polyester. Alternatively, polyester other than poly (trimethylene terephthalate), for example, poly(ethylene terephthalate), nylon and poly(trimethylene terephthalate) may be blended or conjugate-spun (sheath core, side-by-side, etc.) after they were separately synthesized.

The third component to be added includes, for example, an aliphatic dicarboxylic acid (e.g. oxalic acid, adipic acid, etc.), an alicyclic dicarboxylic acid (e.g. cyclohexanedicarboxylic acid, etc.), an aromatic dicarboxylic acid (e.g. isophthalic acid, sodium sulfoisophthalic acid, etc.), an aliphatic glycol (e.g. ethylene glycol, 1,2-propylene glycol, tetramethylene glycol, etc.), an alicyclic glycol (e.g. cyclohexanedimethanol, etc.), an aliphatic glycol containing aromatic (e.g. 1,4-bis(β-hydroxyethoxy)benzene, etc.), an polyether glycol (e.g. polyethylene glycol, polypropylene glycol, etc.), an aliphatic oxycarboxylic acid (e.g. ω-oxycaproic acid, etc.) and an aromatic oxycarboxylic acid (e.g. P-oxybenzoic acid, etc.). A compound having one or three or more ester forming functional group(s) (e.g. benzoic acid, glycerin, etc.) can also be used as long as the polymer is substantially linear.

Furthermore, matting agents such as titanium dioxide, stabilizers such as phosphoric acid, ultraviolet absorbers such as a hydroxybenzophenone derivative, nucleating agents for crystallization such as talc, lubricants such as aerogyl, antioxidants such as hindered phenol derivative, flame retardants, antistatic agents, pigments, fluorescent whiteners, infrared absorbers and defoamers may be contained as the component to be added.

In the present invention, the poly(trimethylene terephthalate)-based fiber can be prepared by applying any known spinning method to the above-mentioned poly (trimethylene terephthalate) polymer. For example, any of a method of preparing an unstretched yarn (undrawn) at a take-up rate of about 1500 m/min and stretching/twisting the resulting yarns by about 2–3.5 times (conventional spinning process), a direct stretching method wherein a spinning step and a stretching or drawing twisting step are directly connected (spin-draw process) and a high-speed spinning method whose take-up rate is 5000 m/min or more (spin take-up process) can be employed.

The poly(trimethylene terephthalate) fiber used in the present invention preferably has an elastic recovery at 20% extension of 70–98%, and more preferably 87–98%, thus providing a fiber having an excellent appearance and tread-proofness.

If the poly(trimethylene terephthalate)-based fiber having the above-mentioned elastic recovery is prepared, the spinning temperature on melt spinning of the polymer is preferably controlled within a range of 270–290° C., and more preferably 270–280° C. As the spinning method, for example, a spin draw method and a conventional spinning process wherein the take-up rate is within a range of 1000 to 2000 m/min are preferred. To obtain the elastic recovery of 87–98%, the spinning method of the latter is particularly preferred. The elastic recovery of the fiber thus obtained is markedly larger than that of the nylon fiber and poly (ethylene terephthalate) fiber used for electrostatic flocking as is mentioned in the examples and comparative examples described hereinafter.

The poly(trimethylene terephthalate)-based fiber used in the present invention can have a section with polygonal shapes, polyphyllous shapes, hollow shapes and free shape, for example, circular shape, triangular shape, L-shape, T-shape, Y-shape, W-shape, octaphyllous shape, flat shape and dog-bone shape.

The fiber for electrostatic flocking of the present invention is a short fiber having a cut length of 0.2–3 mm. When the cut length exceeds 3.0 mm, the tread-proofness is lowered and the surface appearance becomes poor. On the other hand, when the cut length is smaller than 0.2 mm, the high-grade appearance and softness are impaired, which is not preferred. The cut length is preferably 0.5–3.0 mm, and more preferably 0.7–1.5 mm.

The fiber for electrostatic flocking of the present invention can be obtained by cutting a tow having tens to millions of denier, which is obtained by a method of stretching an unstretched yarn tow or bundling stretched yarn to form a tow, into cut or chopped fibers having a length of 0.2–3.0 mm by using a guillotine cutter. A fiber having an arbitrary thickness can be selected, and the single yarn denier is preferably 0.5–10 d, and more preferably 1–5 d.

The fiber for electrostatic flocking of the present invention is preferably subjected to a pre-electrostatic flocking treatment (pre-treatment) for improving the separating and flying properties of the aggregated short fibers in a electrostatic flocking, for example, pre-electrostatic flocking treatment with a treating solution of a silicon compound such as sodium silicate or potassium silicate, and a water-soluble potassium compound such as potassium formate or potassium acetate.

The fiber for electrostatic flocking of the present invention is superior in the dispersibility of the electrostatically flocked short fibers to a conventional coating flock. An excellent dispersibility leads to an excellent appearance of the electrostatically flocked good.

The electrostatic flocking is carried out by generating a high-voltage electrostatic field between electrodes facing each other, disposing a fabric substrate coated with an adhesive on one electrode, applying charges to the pre-electrostatic flocking treated short fibers and enabling the short fibers to fly toward the fabric substrate from the opposite electrode. In this case, when plural short fibers are integrated by fusion or pressing due to the poor dispersibility of the short fibers, or long fibers are included without being cut into pieces of a fixed length, electrostatic flocking is not uniformly carried out and the resulting electrostatically flocked goods have a poor appearance.

There can also be used a method of preparing electrostatically flocked goods having an excellent appearance by further comprising the step of passing the pre-electrostatic flocking treated short fibers through a mesh to remove the integrated fibers and long fibers. However, when the above-mentioned single fiber has a poor dispersibility, the amount of the short fibers passing through the mesh is reduced, thereby to lower the yield and to raise the production cost. Thus, an excellent dispersibility is required of the fiber for electrostatic flocking.

The electrostatically flocked goods of the present invention can be obtained by applying the fiber for electrostatic flocking of the present invention in a high-voltage electrostatic field to fabric substrates, for example, knits such as tricot, woven fabrics and non-woven fabrics, which are coated with an adhesive made of vinyl acetate resin, acrylate resin, acrylic or urethane-based resin or a mixture thereof; and fabric substrate such as various resin sheets made of resin such as vinyl chloride resin.

The fiber constituting the fabric substrate such as knit used in the electrostatically flocked goods of the present invention is not specifically limited, and may be those of special fibers such as ultrafine fiber and dividable ultrafine fiber according to the use and the required quality. Colored electrostatically flocked goods may be obtained by any method such as coloring of raw materials and dyeing of fibers or product.

BEST MODE FOR CARRYING OUT THE INVENTION

The following examples further illustrate the present invention in detail. The performances were evaluated by the following procedures.

(1) Evaluation of Dispersibility of Fibers for Electrostatic Flocking 10 g of fibers for electrostatic flocking (electrification pre-treated fibers) are put in a cylindrical (80 mm in diameter and 100 mm in length) mesh (mesh #20) and the mesh is rotated 25 times (60 rpm). Then, the weight (W) of fibers passed through the mesh is measured and the proportion (mesh pass %) is calculated. The larger the proportion, the better the dispersibility and appearance of the electrostatic flocked good.

$$\text{Mesh pass } (\%) = W/10 \times 100$$

(2) Appearance of Electrostatically Flocked Good

The appearance of the electrostatically flocked good prepared by applying the flock to the surface of a vinyl chloride sheet in a weight of 80–100 g/m$^2$ was visually judged whether or not the length of erect fibers of the electrostatically flocked good is uniform and the flocking density varies according to the following five-grade criteria.

Class 1: extremely uneven surface with a large difference in length of erect fibers and very noticeable unevenness in flocking density Class 2: uneven surface with a large difference in length of erect fibers and noticeable unevenness in flocking density Class 3: uneven surface with a difference in length of erect fibers Class 4: generally even surface with a small difference in length of erect fibers Class 5: very even and uniform surface with no difference in length of erect fibers (3) Elastic Recovery at 20% Extension of Fiber The fiber was attached to a tensile tester under the conditions of an initial load of 0.01 g/d and a distance between chucks of 20 cm, stretched to an extension of 20% at a testing speed of 20 cm/min, and then allowed to stand for one minute. The fiber was returned to the original length (L) at the same speed and the residual extension ($L_1$) was read from a transfer distance of the chuck in a state where a stress is applied. Then, the elastic recovery at 20% extension of fiber was calculated by the following equation.

$$\text{Elastic recovery } (\%) \text{ at 20\% extension of fibers} = (L) - L_1) \times 100/L$$

(4) Evaluation of Tread-proofness of Electrostatically Flocked Good

A weight having diameter of 3 cm and weighing 200 g was placed on the surface of standing fibers of the electrostatically flocked goods prepared by applying the flock to the surface of a vinyl chloride sheet in a weight of 80–100 g/m$^2$ and, after being allowed to stand for 24 hours, the weight was removed. Then, the electrostatically flocked goods were allowed to stand for additional one hour and the shadow (dark area) of flattened lie of piles was visually judged according to the following five-grade criteria.

Class 1: flattened lie of piles is not recovered and the impressed pattern of the weight is exceedingly noticeable Class 2: flattened lie of piles is not recovered and the impressed pattern of the weight is noticeable Class 3: flattened lie of piles is not recovered and the impressed pattern of the weight can be confirmed Class 4: flattened lie of piles is slightly recovered and the impressed pattern of the weight can be slightly confirmed Class 5: flattened lie of piles is recovered and the impressed pattern of the weight can not be noticed (5) Scratch Resistance of Electrostatically Flocked Goods The electrostatically flocked goods prepared by applying the flock to the surface of a vinyl chloride sheet in a weight of 80–100 g/m$^2$ were slowly scratched under a load of 1 kgf by using a copper coin having a diameter of 23.5 mm and a thickness of 1.5 mm and scar was judged by the following three-grade criteria. The flocked goods were irradiated with a fadeometer whose black panel temperature was set to 83° C. for 200 hours, and then scratched by using the same copper coin and scar was visually judged.

Class 1: noticeable scar

Class 2: slight scar

Class 3: no scar (6) Evaluation of Softness of Hand of Standing Fiber Surface in Flocked Goods The hand of the standing fiber surface of the electrostatically flocked goods prepared by applying the flock to the surface of a vinyl chloride sheet in a weight of 80–100 g/m$^2$ was organoleptically judged by five panelist according to the following three-grade criteria.

Excellent: very soft

Ordinary: slightly soft

Poor: hard (7) Measurement of Maximum Extension and Elastic Modulus of Fiber

The properties were measured according to JIS L-1013, L-1015 and L-1095, respectively.

EXAMPLE 1

Poly(trimethylene terephthalate) having ηsp/c of 0.8 was spun under the conditions of a spinning temperature of 275° C. and a spinning rate of 1200 m/min to obtain an unstretched yarn, which was then stretched under the conditions of a hot roll temperature of 55° C., a hot plate temperature of 140° C., a stretching ratio of three times and a stretching rate of 800 m/min to obtain a stretched yarn (having circular section) having 100d/48f. The maximum extension, elastic modulus and elastic recovery at 20% extension of the stretched yarn were 4.0 g/d, 30%, 26 g/d and 90%, respectively.

ηsp/c was determined as follows. That is, a polymer was dissolved at 90° C. in o-chlorophenol in a concentration of 1 g/dl and the resulting solution was transferred to an Ostwald viscometer. Then, the viscosity was measured at 35° C. and asp/c was calculated by the following equation:

$$\eta sp/c=(T/T_0-1)/C$$

where T denotes a dropping time (seconds) of a sample solution, $T_0$ denotes a dropping time (seconds) of a solvent, and C denotes a concentration of a solution (g/dl).

The resulting poly(trimethylene terephthalate) fibers were bundled to form a tow having 1,000,000 denier, which was cut into pieces having a length of 1.0 mm by using a guillotine cutter. The resulting short fibers were dipped in an aqueous solution comprising 1.5% sodium silicate and 3% colloidal silica (adjusted to pH 4 using acetic acid) at 40° C. for 14 minutes, dehydrated, and subsequently dried to obtain pre-electrostatic flocking-treated fibers. The resulting short fibers exhibited a mesh pass percentage of 75% and had an excellent dispersibility. Then, an electrostatically flocked goods were prepared by applying 10 g of the electrostatically flocked short fibers as piles to a 10×10 cm fabric substrate obtained by uniformly coating the surface of a vinyl chloride sheet with an acrylic resin as an adhesive under the conditions of a voltage of 25 KV and a distance between electrodes of 10 cm.

The resulting electrostatically flocked good exhibited an excellent appearance (class 5) and an excellent softness. The electrostatically flocked goods exhibited a tread-proofness (class 5) and a scratch resistance (class 3) that was superior in recovery of piles. The electrostatically flocked good exhibited a scratch resistance after fadeometer exposure (class 3) that was superior in light resistance.

COMPARATIVE EXAMPLE 1

In the same manner as in Example 1, except that a nylon 6 fiber (single yarn denier: 2d, circular cross section) was used in place of the poly(trimethylene terephthalate) fiber, an electrostatically flocked goods were prepared. The resulting short fiber exhibited a mesh pass percentage of 63% so that it was inferior in dispersibility to Example 1.

The resulting electrostatically flocked goods exhibited appearance (class 4) and ordinary softness so that it was inferior to Example 1. The electrostatically flocked goods exhibited a tread-proofness (class 1) that was markedly inferior to Example 1. Furthermore, the electrostatically flocked good exhibited scratch resistance (class 3) that was the same as in Example 1, however, the scratch resistance after fadeometer exposure was lowered to class 1 so that it was inferior in light resistance.

COMPARATIVE EXAMPLE 2

In the same manner as in Example 1, except that a poly(ethylene terephthalate) fiber (single yarn denier: 2d, circular cross-section) was used in place of the poly (trimethylene terephthalate) fiber, an electrostatically flocked goods were prepared. The resulting short fiber exhibited a mesh pass percentage of 66% so that it was inferior in dispersibility to Example 1.

The resulting electrostatically flocked good exhibited appearance (class 1) and poor softness so that it was markedly inferior to Example 1. The electrostatically flocked good exhibited class 1 in all items of the tread-proofness, scratch resistance and scratch resistance after fadeomater exposure so that it was markedly inferior to Example 1.

EXAMPLES 2 to 8

In the same manner as in Example 1, except that the condition of the spinning temperature and spinning rate were changed, an unstretched yarn was made and then draw-twisted to prepare fibers having a different elastic recovery (65–95%) from that of Example 1 as shown in Table 1.

In the same manner as in Example 1, except that different poly(trimethylene terephthalate) fibers were used, electrostatically flocked goods were prepared. The mesh pass percentages of the resulting short fibers was 75% or more so that the resulting electrostatically flocked goods were superior in dispersibility, like Example 1.

The appearance, softness, tread-proofness and scratch resistance of the resulting electrostatically flocked goods were as shown in Table 1. Comparing the electrostatically flocked goods having an elastic modulus of 85% or less with the electrostatically flocked goods having an elastic modulus of 87% or more, the latter were superior in appearance, tread-proofness and scratch resistance.

EXAMPLE 9

In the same manner as in Example 1, a poly(trimethylene terephthalate) stretched yarn (circular cross-section) having 75d/72f was obtained. The maximum extension, elastic modulus and elastic recovery at 20% extension of the stretched yarn were 4.2 g/d, 37%, 26 g/d and 89%, respectively. In the same manner as in Example 1, an electrostatically flocked goods were prepared. The mesh pass percentage of the resulting short fiber was 70%.

The resulting electrostatically flocked goods exhibited an excellent appearance (class 5) and an excellent softness. The electrostatically flocked goods exhibited a tread-proofness (class 4) and scratch resistance (class 3) so that it was superior in recovery of piles, and exhibited a scratch resistance after fadeometer exposure (class 3) so that it was also superior in light resistance.

COMPARATIVE EXAMPLE 3

In the same manner as in Example 9, except that a nylon 6 fiber (single yarn denier: 1d, circular cross-section) was used in place of the poly(trimethylene terephthalate) fiber, electrostatically flocked goods were prepared. The resulting short fiber exhibited a mesh pass percentage of 62% so that it was inferior in dispersibility to Example 9.

The resulting electrostatically flocked goods exhibited an appearance (class 4) and ordinary softness so that they were inferior to Example 9. The electrostatically flocked goods exhibited tread-proofness (class 1) so that they were drastically inferior to Example 9. Furthermore, the electrostatically flocked goods exhibited scratch resistance (class 2) that was inferior to Example 9, and the scratch resistance after fadeometer exposure was lowered to class 1 so that it was inferior in light resistance.

COMPARATIVE EXAMPLE 4

In the same manner as in Example 9, except that a poly(ethylene terephthalate) fiber (single yarn denier: 1d, circular section) was used in place of the poly(trimethylene terephthalate) fiber, electrostatically flocked goods were prepared. The resulting short fiber exhibited a mesh pass percentage of 45% so that it was inferior in dispersibility to Example 9.

The resulting electrostatically flocked goods exhibited an appearance (class 1) and a poor softness so that it was drastically inferior to Example 9. Furthermore, the electrostatically flocked goods exhibited class 1 in all items of tread-proofness, scratch resistance and scratch resistance after fadeomater exposure so that it was drastically inferior to Example 9.

TABLE 1

| | | Examples | | | | | |
|---|---|---|---|---|---|---|---|
| | | 1 | 2 | 3 | 4 | 5 | 6 |
| Fibers | | PTT | PTT | PTT | PTT | PTT | PTT |
| Single yarn denier (d) | | 2.1 | 2.1 | 2.1 | 2.1 | 2.1 | 2.1 |
| Cut length (mm) | | 1.0 | 1.0 | 1.0 | 1.0 | 1.0 | 1.0 |
| Elastic recovery (%) | | 90 | 65 | 70 | 80 | 83 | 85 |
| Mesh pass (%) | | 75 | 75 | 77 | 80 | 74 | 75 |
| Appearance (class) | | 5 | 4 | 4 | 4 | 4 | 5 |
| Softness | | Excellent | Excellent | Excellent | Excellent | Excellent | Excellent |
| Tread-proofness (class) | | 5 | 3 | 4 | 4 | 4 | 4 |
| Scratch resistance (class) | Initial | 3 | 2 | 2 | 2 | 2 | 2 |
| | After light exposure | 3 | 2 | 2 | 2 | 2 | 2 |

| | | Examples | | | Comparative Examples | | | |
|---|---|---|---|---|---|---|---|---|
| | | 7 | 8 | 9 | 1 | 2 | 3 | 4 |
| Fibers | | PTT*1 | PTT | PTT | N6 | PET | N6 | PET |
| Single yarn denier (d) | | 2.1 | 2.1 | 1.0 | 2.0 | 2.0 | 1.0 | 1.0 |
| Cut length (mm) | | 1.0 | 1.0 | 0.6 | 1.0 | 1.0 | 0.6 | 0.6 |
| Elastic recovery (%) | | 87 | 95 | 89 | 62 | 29 | 60 | 31 |
| Mesh pass (%) | | 77 | 76 | 70 | 63 | 66 | 62 | 45 |
| Appearance (class) | | 5 | 5 | 5 | 4 | 1 | 4 | 1 |
| Softness | | Excellent | Excellent | Excellent | Ordinary | Poor | Ordinary | Poor |
| Tread-proofness (class) | | 5 | 5 | 4 | 1 | 1 | 1 | 1 |
| Scratch resistance (class) | Initial | 3 | 3 | 3 | 3 | 1 | 2 | 1 |
| | After light exposure | 3 | 3 | 3 | 1 | 1 | 1 | 1 |

PTT: Poly(trimethylene terephthalate) fiber
N6: Nylon 6 fiber
PET: Poly(ethylene terephthalate) fiber

INDUSTRIAL APPLICABILITY

The fiber for electrostatic flocking of the present invention is superior in dispersibility to a conventional fiber for electrostatic flocking, and the resultant electrostatically flocked goods are superior in appearance, tread-proofness, scratch resistance and light resistance to a conventional one. Accordingly, the electrostatically flocked goods of the present invention are suited for use as automotive interior materials, for example, car seat coverings, pillars, dash boards, linings for doors and ceiling materials. When using the goods of the present invention as pillars and dash boards, it is directly flocked to a resin molded article, or flocked goods obtained by flocking to an any fabric substrate are applied and assembled by using a tool such as wooden hammer. Therefore, the goods of the present invention are hardly scratched on assembly. In addition, the electrostatically flocked goods of the present invention are suited for use in furniture and chair coverings, toys, ornaments and footwear.

What is claimed is:

1. A fiber for electrostatic flocking, characterized in that said fiber is a poly(trimethylene terephthalate) short fiber having a cut length of 0.2–3 mm.

2. Electrostatically flocked goods, characterized in that said electrostatically flocked goods are prepared by electrostatically flocking said fiber for electrostatic flocking of claim 1.

* * * * *